US006449800B1

(12) United States Patent
Gotham

(10) Patent No.: US 6,449,800 B1
(45) Date of Patent: Sep. 17, 2002

(54) BLOWER APPARATUS WITH BRUSH FOR SCAVENGING SURFACE

(76) Inventor: Brooks M. Gotham, 625 S. Meier Rd., Mt. Prospect, IL (US) 60096-3946

( * ) Notice: Subject to any disclaimer, the term of this patent is extended or adjusted under 35 U.S.C. 154(b) by 0 days.

(21) Appl. No.: 09/541,565

(22) Filed: Apr. 3, 2000

(51) Int. Cl.[7] ..... A47L 5/30

(52) U.S. Cl. ..... 15/340.3; 15/348; 15/368; 15/389; 37/244

(58) Field of Search ..... 15/348, 349, 340.3; 37/244, 248, 251

(56) References Cited

U.S. PATENT DOCUMENTS

| | | | | | |
|---|---|---|---|---|---|
| 3,636,585 | A | * | 1/1972 | Larsen | 15/340.3 X |
| 3,735,510 | A | * | 5/1973 | Godfrey et al. | 15/340.3 X |
| 3,766,586 | A | * | 10/1973 | Krickovich | 15/83 |
| 4,393,537 | A | * | 7/1983 | Reprogle et al. | 15/348 |
| 4,701,969 | A | | 10/1987 | Berfield et al. | |
| 4,809,380 | A | * | 3/1989 | VanGinhoven et al. | 15/348 X |
| 5,077,920 | A | | 1/1992 | Farrell | |
| 5,742,967 | A | * | 4/1998 | Giessler | 37/248 X |
| 5,784,756 | A | * | 7/1998 | Slocum et al. | 15/348 |
| 5,797,203 | A | | 8/1998 | Vanderlinden | |
| 6,260,293 | B1 | * | 7/2001 | Monroe | 37/248 |

* cited by examiner

*Primary Examiner*—Chris K. Moore
(74) *Attorney, Agent, or Firm*—Skinner and Associates

(57) ABSTRACT

A blower head, comprising a frame, a brush rotatably supported by the frame, a sweeper drive adapted for rotating said brush to sweep a surface, and a blower unit adapted for removing swept-up particles away from the surface. The frame includes a mouth portion and a throat portion. The brush is rotatably supported by the frame within the mouth portion. The sweeper drive rotates the brush to sweep particles such as snow or ice on a surface toward the frame. The mouth portion and the throat portion are constructed and arranged to funnel swept-up particles from the mouth portion and into the throat portion and the blower unit positioned therein. The blower head further includes an exit chute. The blower unit creates a pressure differential between the mouth portion and the exit chute sufficient to draw the swept-up particles from the mouth portion and into the throat portion, and to blow the swept-up particles out through the exit chute. The invention further includes a method for scavenging surfaces, such as surfaces packed with snow and/or ice, comprising the steps of rotating a brush to scavenge and sweep a surface, drawing swept-up particles away from the surface, and blowing the swept-up particles out through an exit chute.

10 Claims, 8 Drawing Sheets

BLOWER APPARATUS WITH BRUSH FOR SCAVENGING SURFACE

BACKGROUND OF THE INVENTION

1. Field of the Invention

The present invention relates, generally, to small industrial and consumer-related blowers used to remove particles from a surface. More particularly, the invention relates to a blower apparatus and method for scavenging a surface and sweeping up particles using a rotary brush, and then blowing the swept-up particles away from the surface. The present invention is particularly useful for removing packed snow and ice.

2. Background Information

The state of the art in general includes various apparatus and methods for cleaning surfaces and removing snow, ice or debris. These known apparatus and methods are believed to have significant limitations and shortcomings. For example, it can be difficult to completely clean a surface using conventional single-stage and double-stage snow blowers, particularly if the surface is covered with ice and/or packed snow. Chisels, picks, and a considerable amount of physical effort are typically necessary to loosen or break the snow and ice from the surface. Chemicals and/or heat also may be applied to loosen or melt the packed snow and ice, but the application of the chemicals and heat may be undesirable for economic and environmental reasons.

Rotary brooms for sweeping surfaces are typically positioned and arranged to either push the debris forward and/or to the side, or to push the debris into a pan or bin. These brooms include relatively stiff bristles that scavenge, i.e. scrub or sweep clean, a surface as the broom rotates on the surface. These brooms wear with use causing the length of the bristles and the overall useful diameter of the broom to shorten. Eventually, the broom needs to be replaced since the bristles have been worn to the point where they no longer can effectively sweep the surface.

This invention provides a blower apparatus, particularly a blower head for the apparatus, which is believed to constitute an improvement over existing technology.

BRIEF SUMMARY OF THE INVENTION

The present invention provides a blower apparatus with a brush for scavenging surfaces. The blower head of the apparatus generally comprises a frame, a brush rotatably supported by the frame, a sweeper drive adapted for rotating the brush to sweep a surface, and a blower unit adapted for removing swept-up particles away from the surface. The frame includes a mouth portion and a throat portion. The brush is rotatably supported by the frame within the mouth portion. The sweeper drive rotates the brush to sweep particles from a surface back into the mouth portion. The mouth portion and the throat portion are constructed and arranged to funnel the swept-up particles into the throat portion where the blower unit is located.

The blower head further includes an exit chute attached or otherwise connected to or formed with the throat portion. The blower unit is positioned in the throat portion and creates a pressure differential between the mouth portion and the exit chute sufficient to draw the swept-up particles from the mouth portion and into the throat portion, and then blow these particles out through the exit chute.

The present invention also includes a method for scavenging surfaces, such as ice-covered and snow-packed surfaces. The method generally comprises the steps of rotating a brush to scavenge and sweep a surface, drawing swept-up particles away from the surface, and blowing the swept-up particles out through an exit chute.

In a preferred embodiment, the present invention forms part of a snow blower that is able to clean snow-packed surfaces by scavenging the surface to form snow particles and then sweeping the particles toward a blower unit. The blower unit draws these particles into a throat portion, and then blows them through the exit chute. The blower unit may be driven by a variable speed drive that decreases the effective gear ratio and increases the torque on the blower unit when the blower unit encounters a clog. In this embodiment, the engine or motive power system will not bog down when, for example, the blower head encounters heavy or large amounts of snow.

In another embodiment, the brush may comprise brush strips attached to the peripheral edge of a conventional, helical-shaped snow blower auger. This embodiment can be retrofitted easily onto an existing snow blower. The attached brush strips scavenge a snow-packed surface allowing the conventional one-stage or two-stage snow blower to throw the scavenged or swept-up snow particles away from the path.

In another embodiment, the brush may be formed with a helical-shaped pattern adapted for moving swept-up particles along the axis of the brush and toward the throat portion as the brush rotates. This embodiment assists with drawing the swept-up particles into the throat portion and the blower unit positioned therein, and ultimately assists with blowing the swept-up particles out through the chute.

In another embodiment, the brush may be formed as two distinct portions. Each portion of the brush is constructed and arranged to replace an auger in a conventional two-stage snow blower.

The features, benefits and objects of this invention will become clear to those skilled in the art by reference to the following description, claims and drawings.

DETAILED DESCRIPTION

Figure 1:
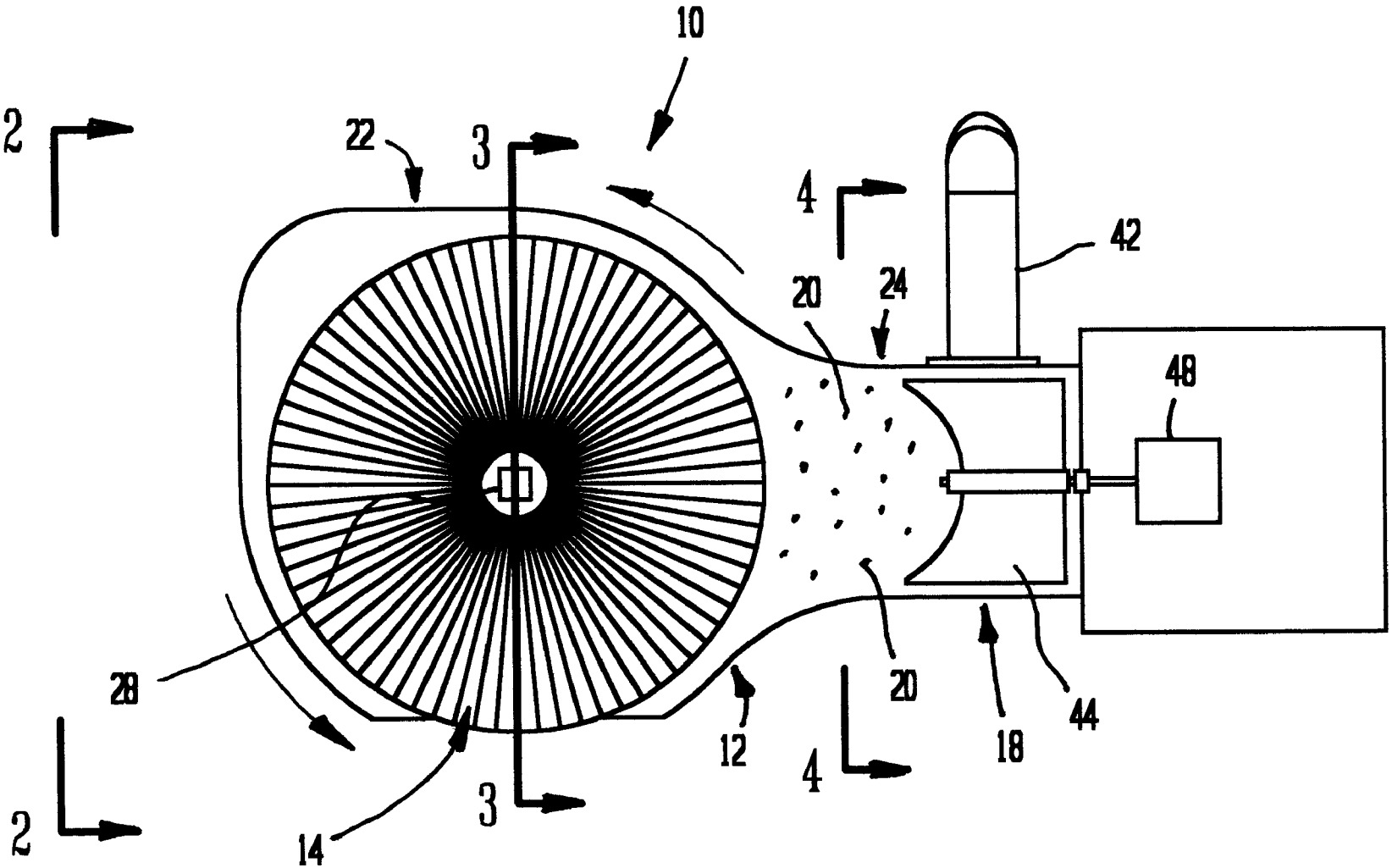
FIG. 1 is a side view showing the interior of the blower head of the present invention.
Figure 2:
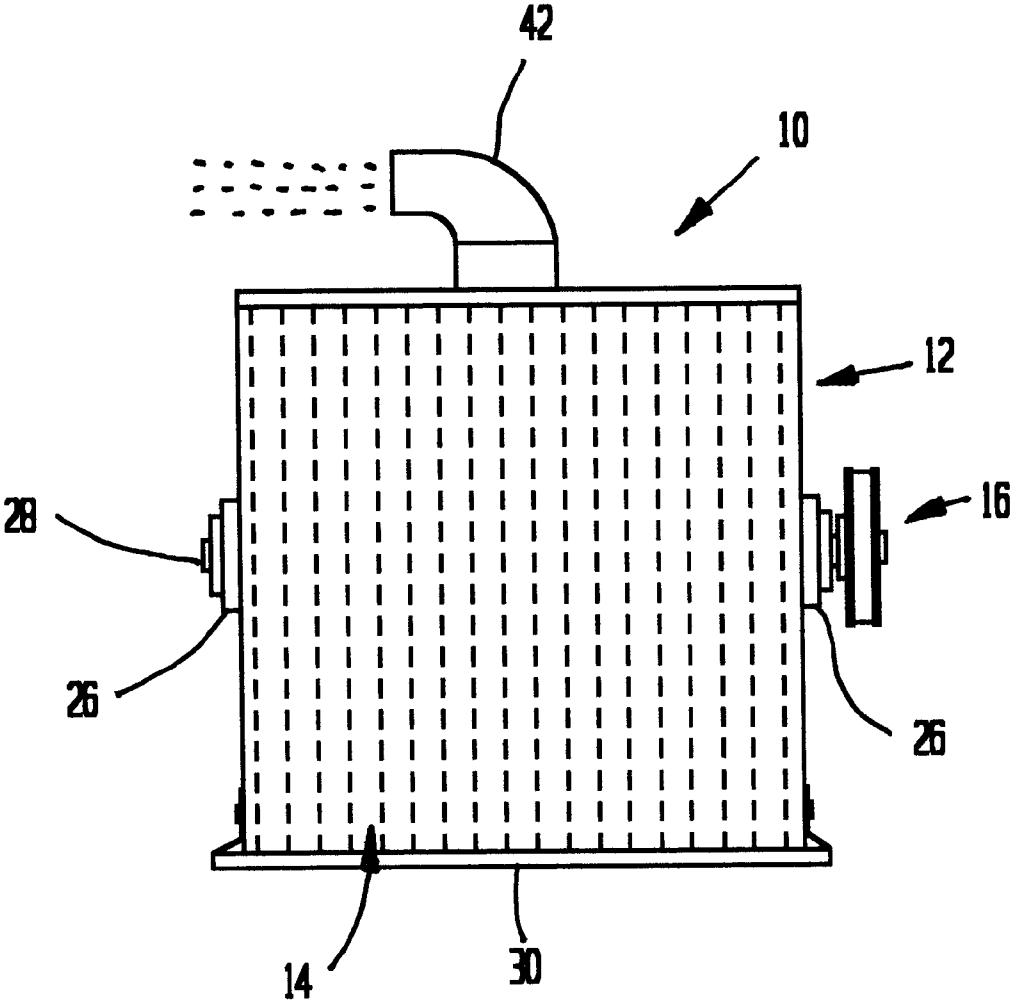
FIG. 2 is a front view along line 2—2 of the blower head of FIG. 1.
Figure 4:
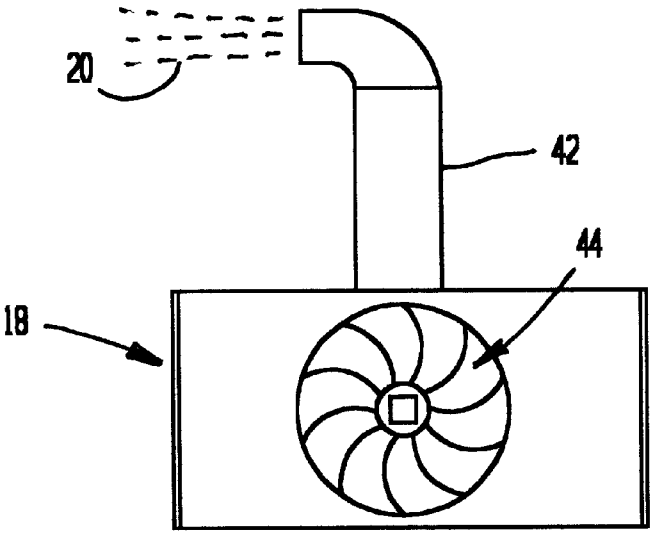
FIG. 4 is a sectional view along line 4—4 of FIG. 1.
Figure 3:
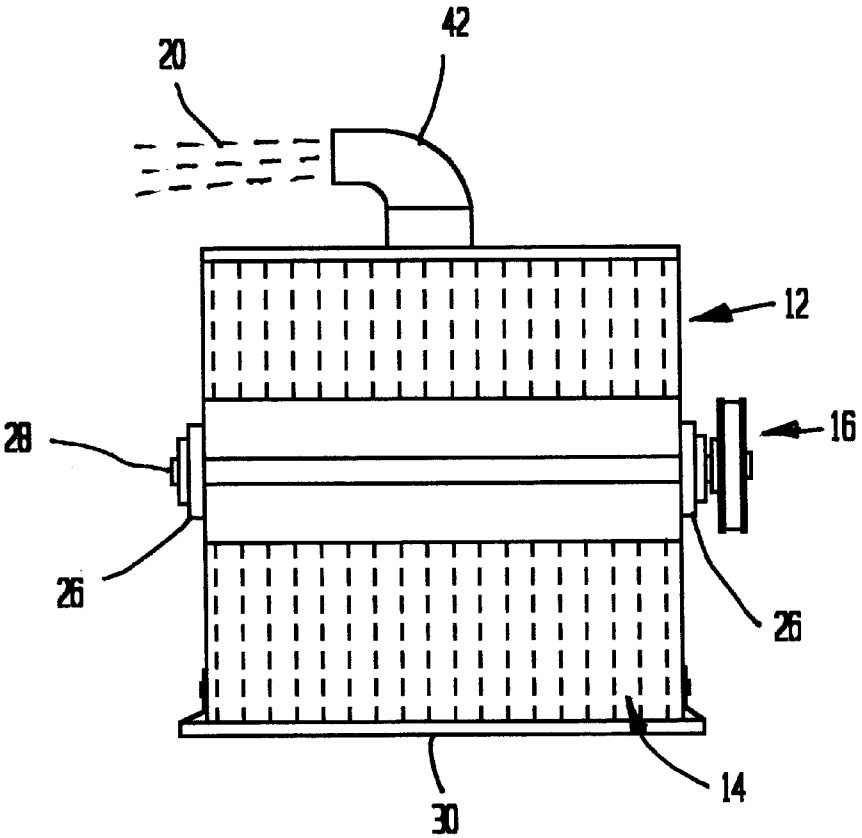
FIG. 3 is a sectional view along line 3—3 of FIG. 1.

The present invention provides a blower apparatus with a brush for scavenging surfaces, the blower head of which is illustrated in the figures. Referring to FIGS. 1–8, an example of the preferred embodiment of the present invention is illustrated and generally indicated by the reference numeral 10. The blower head 10 may be either attached to a vehicle such as a tractor, for example, or may be incorporated into a self-propelled apparatus that includes wheels, a drive mechanism, and an engine or other motive system.

The blower head 10 generally comprises a frame 12, a brush 14 or brush portions rotatably supported by the frame 12, a sweeper drive 16 that rotates the brush 14 to sweep a surface, and a blower unit 18 that removes swept-up particles 20 away from the surface. The frame 12 includes a mouth portion 22 and a throat portion 24, and is preferably formed as a unitary piece with smooth transitions between the interior walls of the mouth portion 22 and throat portion 24. Alternatively, the frame 12 may be formed from multiple pieces that are welded or otherwise attached to each other.

The brush 14 is rotatably supported within the mouth portion 22 by journal bearings 26 attached to the frame 12. The sweeper drive 16 rotates the brush 14 to sweep particles from a surface into the mouth portion 22 and toward the throat portion 24. The brush 14, such as a conventional rotary brush, generally comprises a central shaft 28 and stiff bristles 30 that radially extend away from the shaft 28. As the brush 14 rotates, the ends of the bristles 30 sweep across to scavenge or scrub the surface. In a snow blower embodiment, the stiff bristles break apart 30 packed snow and ice into smaller particles 20. The bristles flex as they contact the surface during the sweeping motion, and "flick" the particles 20 away from the brush 14 and into the air space in the mouth portion 22 after the bristles rotate away from contact with the surface. These flicked or swept-up particles 20 have a velocity that is directed toward the frame 12 of the blower head 10. The smooth interior walls of mouth portion 22 and the throat portion 24 funnel these particles 20 from the mouth portion 22 and into the throat portion 24 where the blower unit 18 is located.

Figure 6:
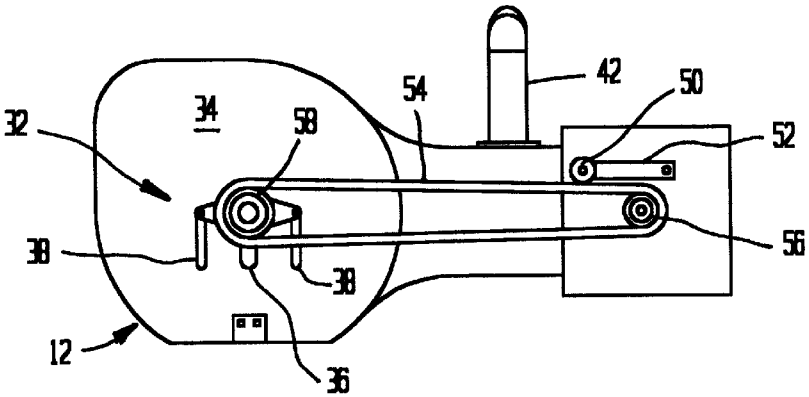
FIG. 6 is a side view of the blower head of FIG. 5 showing the sweeper drive.
Figure 5:
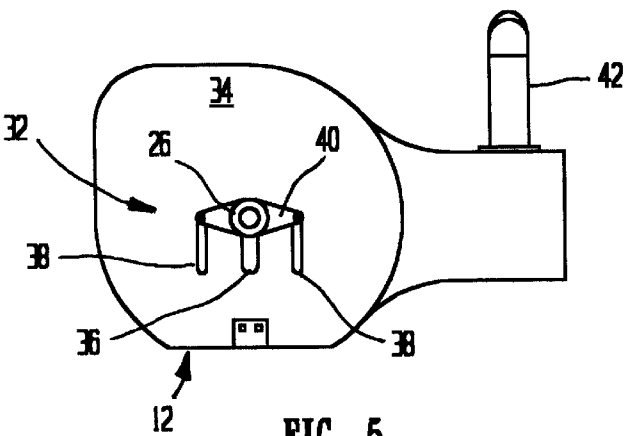
FIG. 5 is a side view showing the exterior of the blower head.
Figure 8:
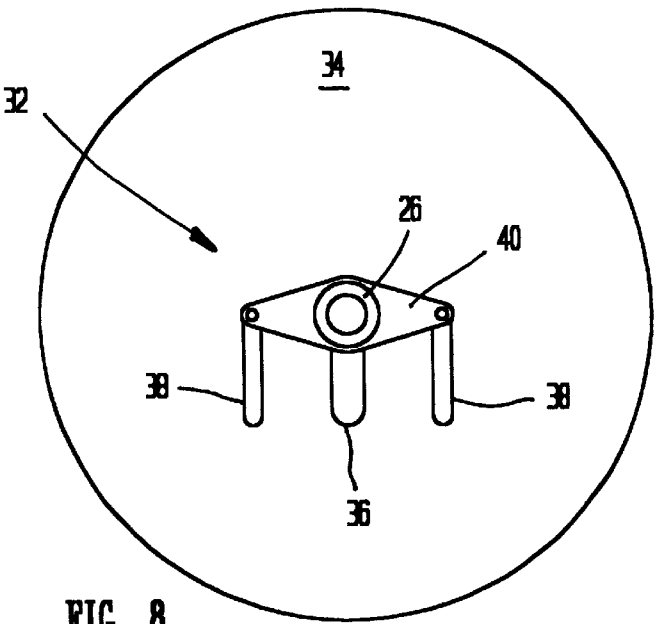
FIG. 8 is a side view of the mouth portion of the blower head showing the brush adjustment mechanism.
Figure 9:
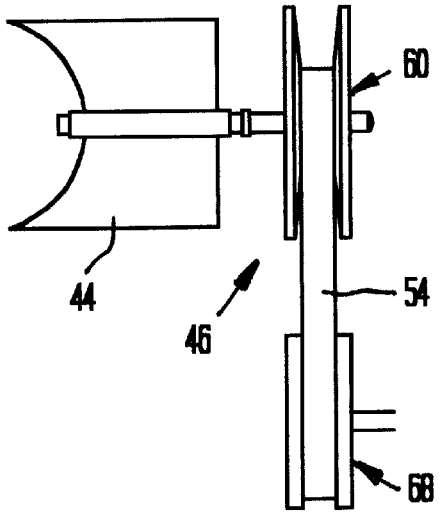
FIG. 9 is a plan view of a variable speed blower drive used in the blower head of the present invention.
Figure 10:
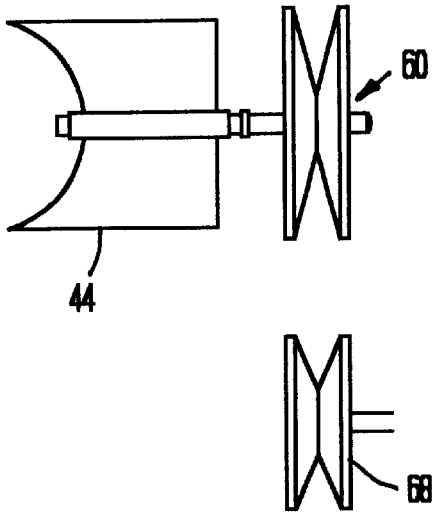
FIG. 10 is a plan view of the pulleys used in the variable speed blower drive of FIG. 9.

The bristles 30 of the brush 14 become shorter as the brush wears. Therefore, it is desirable to rotatably support the brush 14 in an adjustable position with respect to the frame 12 to extend the overall life of the brush 14. The brush 14 can then be re-positioned as necessary to maintain an operable contact with the surface as it wears down. An example of a vertical brush adjustment means 32 is illustrated in FIGS. 5, 6 and 8. As shown, each of the opposing side walls 34 of the mouth portion 22 are formed with a vertically-oriented shaft slot 36 and one or more corresponding vertically-oriented fastener slots 38. A mounting bracket 40 is fastened to each of the opposing side walls by extending a fastener, such as a bolt and nut combination, through the bracket 40 and the fastener slot(s) 38. The brackets, slots and corresponding fasteners form adjustable mounting slides. Each mounting bracket 40 includes a journal bearing 26 adapted to rotatably receive the journal of the brush shaft 28. Therefore, the present invention allows an operator to adjust the position of the brush 14 to accommodate brush wear by loosening the fasteners, sliding the brackets down a desired distance, and tightening the fasteners to secure the brackets to the opposing walls of the mouth portion.

The blower head 10 further includes an exit chute 42 attached or otherwise connected to or formed with the throat portion 24. The blower unit 18 is positioned in the throat portion 24, and creates a pressure differential between the mouth portion 22 and the exit chute 42 sufficient to draw the swept-up particles 20 from the mouth portion 22 and into the throat portion 24, and to blow these particles out through the exit chute 42. The blower unit 18 includes a fan 44 that preferably operates at high revolutions per minute in order to create the pressure differential required to discharge the particles 20 through the exit chute 42. Therefore, the pressure differential created by the blower unit 18 is the difference between the low pressure or vacuum on its mouth side 22 and the high pressure on its exit chute 42 side.

The blower head 10 of the present invention includes the sweeper drive 16 adapted for rotating the brush 14 and a blower drive 46 adapted for rotating the fan 44 within the blower unit 18. Both the blower drive 46 and sweeper drive 16 are powered by a power source, such as a central motive system or engine for a self-propelled machine. A gear box 48 is used to obtain the proper gear ratios between the motive system and both the blower drive 46 and the sweeper drive 16. The Figures. illustrate belt drives, although a number of drive systems can be used, including belt drives, power-takeoff (PTO) shaft drives, chain drives or angular/bevel shaft drives.

Figure 7:
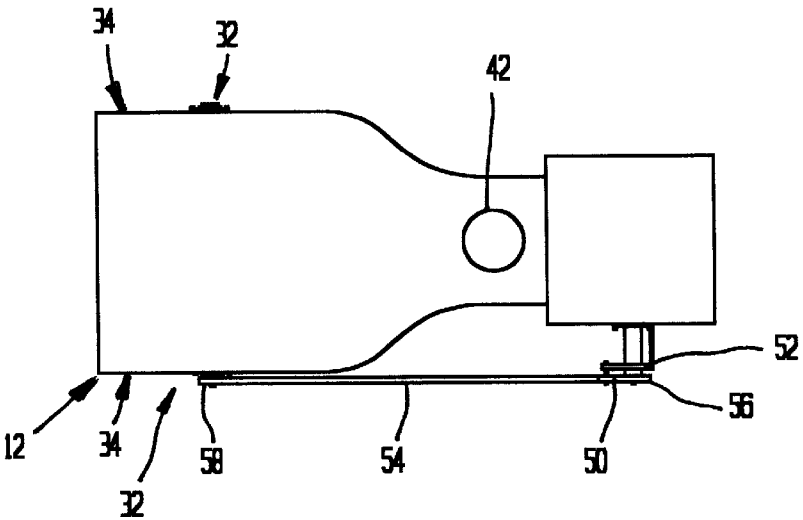
FIG. 7 is a top view of the blower head of FIG. 6.

The sweeper drive is illustrated in FIGS. 6 and 7. An idler wheel 50 attached to a pivoting arm 52 has an engaged and a disengaged position. In a disengaged position, a belt 54 positioned around a drive pulley 56 and a brush pulley 58 remains slack so that the belt 54 does not turn with the rotating drive pulley 56 and does not rotate the brush 14. When the idler wheel 50 is pivoted into the engaged position, it contacts and increases tension in the belt 54, which causes the belt 54 to grip the pulleys 56 and 58 and rotate the brush 14.

The exit chute 42 may be a conventional snow blower chute that is adjusted to change the direction of the discharged particles 20. Additionally, the exit chute 42 may include a baffle means that slows down the exit velocity of the particles, even as the blower unit 18 continues to create an effectively high vacuum that draws the particles 20 through the throat portion 24. Furthermore, the exit chute 42 may be designed with a bag attachment that, similar to a collection bag for clippings in a conventional lawn mower, enables a bag to be attached to the handle of the blower unit and to be positioned and arranged to collect the discharged particles. The bag attachment is particularly useful for sweeping and removing dirt, rocks, sand and other granular substances from a surface.

In a preferred embodiment, the blower head 10 of the present invention forms part of either a self-propelled snow blower or as a snow blower attachment or implement for a vehicle such as a tractor or truck. The blower head 10 cleans snow-packed or ice-covered surfaces by scavenging the surfaces to form particles, flicking or sweeping the particles back toward a blower unit, drawing the swept-up particles through the blower unit 18, and blowing the particles 20 through the exit chute 42.

Figure 15C:
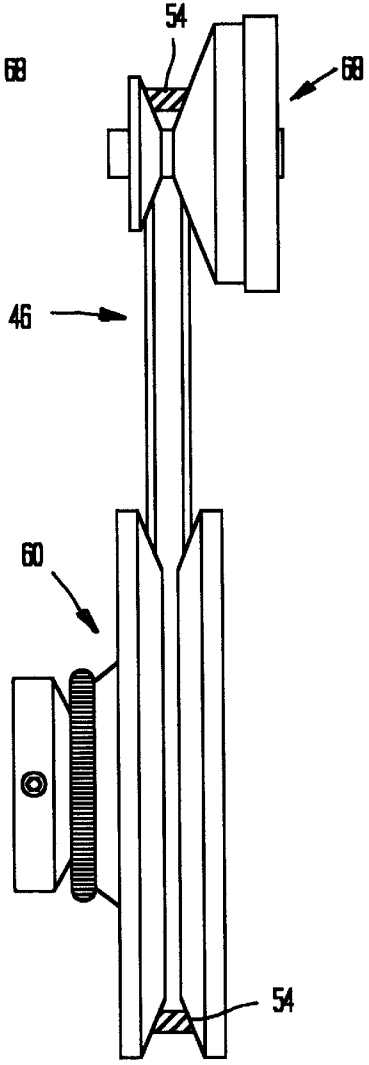
FIGS. 15*a*–15*c* illustrate the progression of a variable speed drive between an idling position (14*a*), a low gear position (14*b*) and a high gear position (14*c*).
Figure 15B:
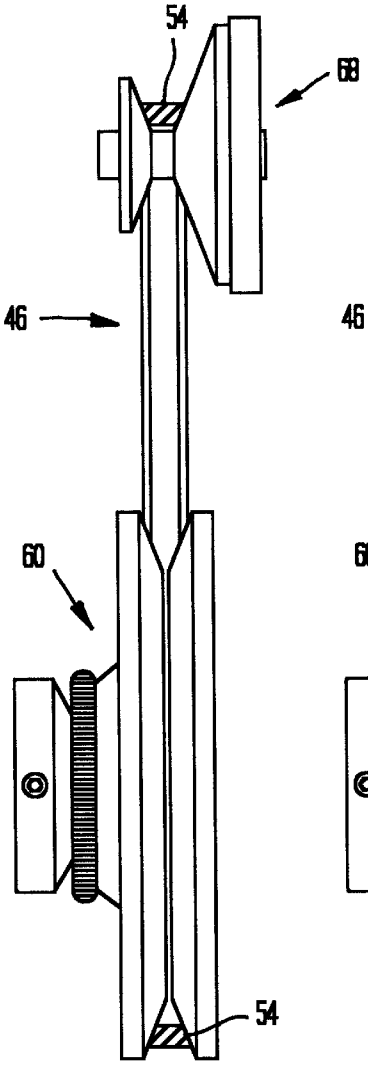
Figure 15A:
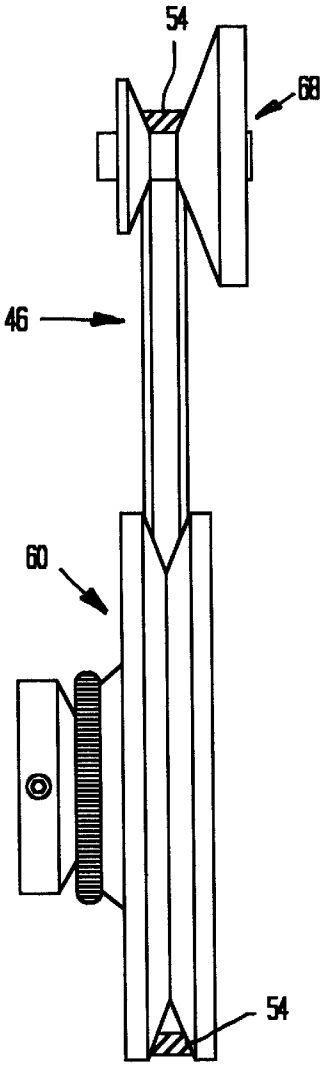
Figure 14:
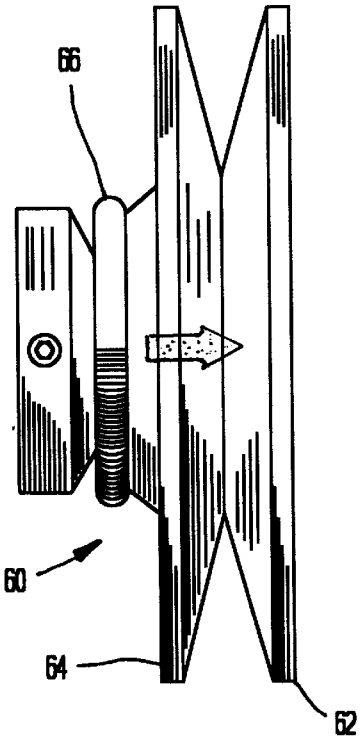
FIG. 14 is a plan view of a spring-loaded, variable speed pulley.

Referring to FIGS. 9, 10, 14 and 15*a*–15*c*, the blower unit 18 may driven by a variable speed blower unit drive 46 that decreases the effective gear ratio and increases the torque on the blower unit when it encounters a clog. Therefore, the engine or motive power system will not bog down when the blower head 10 encounters heavy or large amounts of snow. Referring specifically to FIG. 14, a variable speed blower unit drive 46 includes a variable speed pulley 60, which includes a fixed flange 62, a floating flange 64, and a spring 66 that tends to keep the flanges 60 and 62 closed. As shown in FIG. 15*a*, the drive idles when a slack belt 54 cannot turn with the drive pulley 68. FIG. 15*b* illustrates a lower gear and FIG. 15*c* illustrates a higher gear. It can be seen that the belt 54 slips deeper into the variable speed pulley 60 as the speed increases.

Figure 13:
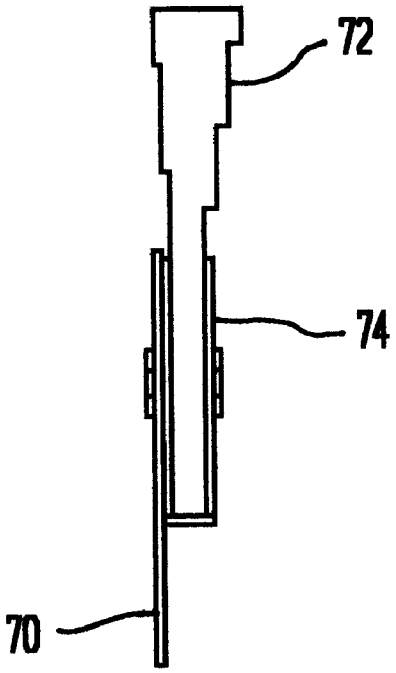
FIG. 13 is a sectional view taken along line 13—13 of FIG. 12.
Figure 12:
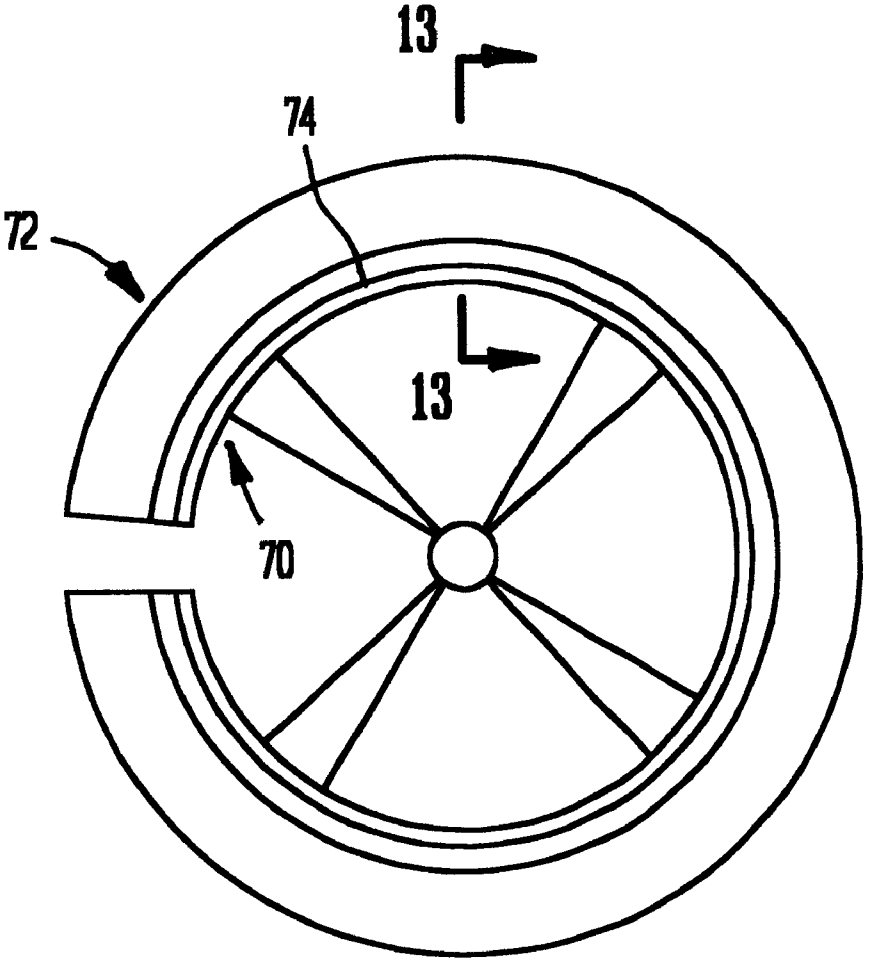
FIG. 12 is a side view of brush strips attached to a conventional snow blower auger.

Referring to FIG. 12–13, the brush may comprise brush strips 72 attached to a conventional, helical-shaped snow blower auger 70. In FIG. 13, a brush strip 72 is shown fastened to the auger 70 using a bolt and a u-shaped channel or clamp 74. As these brush strips 72 are easily added onto an auger 70, they provide a means for retrofitting an existing snow blower to scavenge a surface. This embodiment does not include a blower unit but rather uses the conventional one-stage or two-stage snow blower to throw the scavenged or swept-up snow particles.

Figure 11:
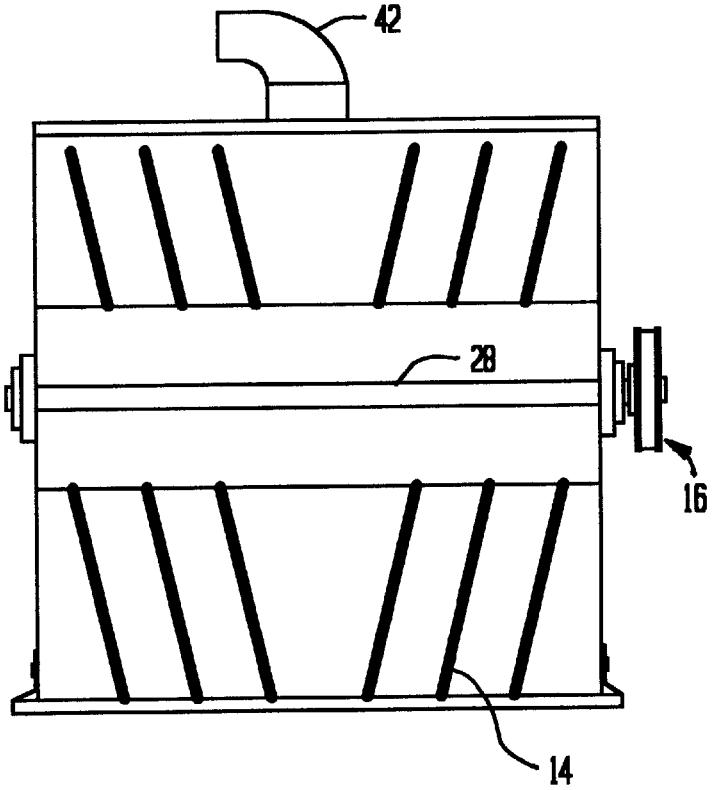
FIG. 11 is a front view of a modified conventional snow blower.

Referring to FIG. 11, the brush 14 may be formed with helical-shaped pattern(s) adapted for moving swept-up particles 20 along the axis of the brush 14 as it rotates. This embodiment assists with drawing the swept-up particles 20 toward the throat portion 24 and the blower unit 18 positioned therein, which enhances the overall performance of the apparatus.

Figure 17:
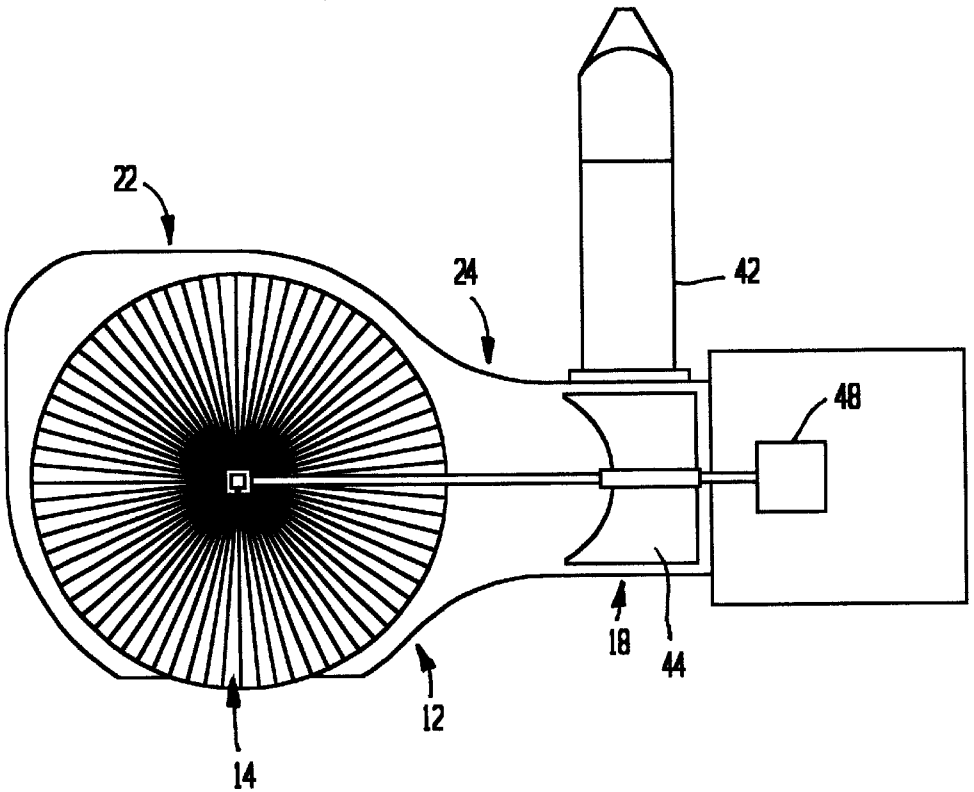
FIG. 17 is a sectional view taken along line 17—17 of FIG. 16.
Figure 16:
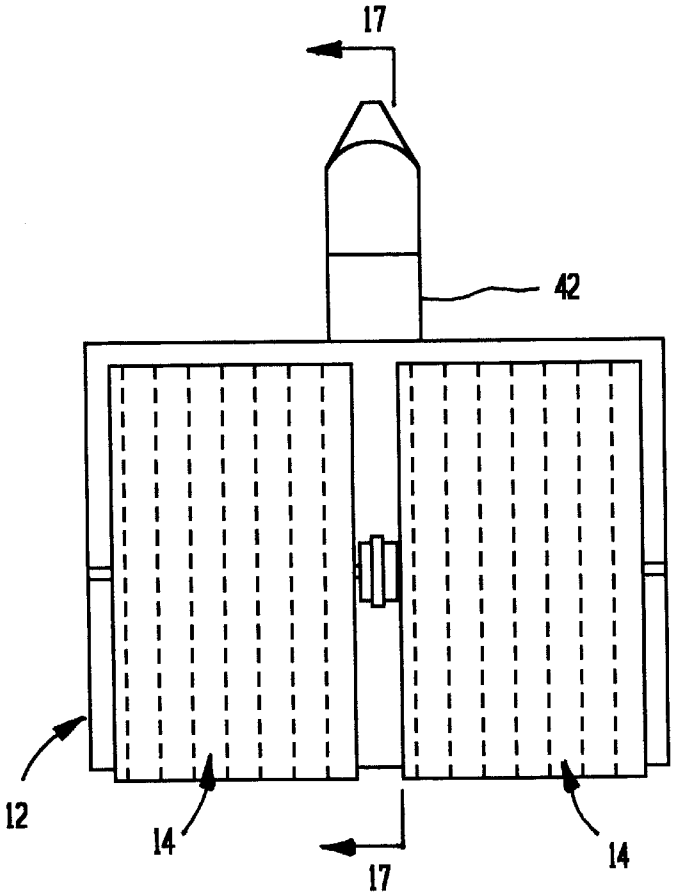
FIG. 16 is a front view of two brush portions constructed and arranged to replace the augers in a conventional two-stage snow blower.

Referring to FIGS. 16 and 17, another embodiment of the present invention is shown. In this embodiment, two separate brushes are constructed and arranged to replace the two augers in a conventional two-stage snow blower. The auger drive mechanism in the conventional blower remains the same.

The invention further includes a method for scavenging surfaces, such as ice-covered or snow-packed surface, which generally comprises the steps of rotating a brush to scavenge and sweep a surface, drawing swept-up particles away from the surface, and blowing the swept-up particles out through an exit chute. The step of rotating the brush moves swept-up particles toward the throat portion to assist with the step of drawing swept-up particles away from the surface and blowing these particles out through an exit chute. Additionally, the step of rotating the brush may include the step of adjusting the position of the brush to accommodate brush wear. The method for scavenging surfaces may further include the step of reacting to a clog encountered by a blower unit by decreasing the effective gear ratio and increasing torque on the blower unit by using a variable speed drive.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A blower head, comprising:

(a) a frame;

(b) a brush rotatably supported by said frame;

(c) a sweeper drive adapted for rotating said brush to sweep a surface; and (d) a blower unit, connected to said frame, adapted for removing swept-up particles away from said surface, said blower unit being driven by a variable speed drive adapted for decreasing the effective gear ratio and increasing torque on said blower unit when said blower unit encounters a clog.

2. The blower head of claim 1, wherein said brush is rotatably supported in an adjustable position with respect to said frame to accommodate brush wear.

3. The blower head of claim 2, wherein said frame includes vertically adjustable mounting brackets attached to said frame, said brackets being adapted for rotatably supporting said brush in said adjustable position.

4. The blower head of claim 1, wherein said frame includes both a mouth portion adapted for rotatably supporting said brush and a throat portion communicatively connected to said mouth portion.

5. The blower head of claim 4, wherein said mouth portion and said throat portion are constructed and arranged to funnel said swept-up particles from said mouth portion and into said throat portion.

6. The blower head of claim 4, further comprising an exit chute connected to said throat portion, wherein said blower unit creates a pressure differential between said mouth portion and said exit chute, said pressure differential being sufficient to draw said swept-up particles from said mouth portion into said throat portion and to blow said swept-up particles out through said exit chute.

7. The blower head of claim 6, wherein said blower unit includes a fan positioned in said throat portion, said pressure differential being created by rotating said fan at high revolutions per minute.

8. The blower head of claim 1, wherein said blower head forms part of a self-propelled machine driven by a motive system, said motive system powering said blower unit and said sweeper drive.

9. The blower head of claim 1, wherein said brush comprises a helical shaped auger used in a snow blower, said auger having a peripheral edge, said brush further comprising one or more brush strips attached to said peripheral edge of said auger, said brush strips being positioned and arranged to scavenge said surface.

10. The blower head of claim 1, wherein said brush has an axis and is formed with a helical-shaped bristle pattern adapted for moving said swept particles along said axis as said brush rotates.

* * * * *